United States Patent [19]

Good, deceased et al.

[11] 4,222,851

[45] Sep. 16, 1980

[54] RECOVERY OF ASPHALT SHINGLE COMPONENTS BY SOLVENT EXTRACTION

[75] Inventors: Robert D. Good, deceased, late of Pittsburgh, Pa., by Mary E. Good, executrix; Paul P. Quenin, Pittsburgh, Pa.

[73] Assignee: Dravo Corporation, Pittsburgh, Pa.

[21] Appl. No.: 958,172

[22] Filed: Nov. 6, 1978

[51] Int. Cl.[2] ..... C10C 1/00

[52] U.S. Cl. ..... 208/45; 208/39; 423/658.5

[58] Field of Search ..... 208/45, 39; 423/658.5

[56] References Cited

U.S. PATENT DOCUMENTS

| | | | |
|---|---|---|---|
| 3,367,034 | 2/1968 | Good | 34/1 |
| 3,992,281 | 11/1976 | Benade | 208/45 |
| 4,108,681 | 8/1978 | Lawson et al. | 208/45 |

*Primary Examiner*—Veronica O'Keefe

*Attorney, Agent, or Firm*—Louis E. Marn; Elliot M. Olstein

[57] ABSTRACT

This invention relates to the treatment of a multi-component material to separate and recover the components thereof, and more particularly to the solvent extraction or treatment of waste asphalt shingles to recover, in reusable form, the filler, fiber, granules and like solid components as well as asphalt therefrom.

14 Claims, 2 Drawing Figures

RECOVERY OF ASPHALT SHINGLE COMPONENTS BY SOLVENT EXTRACTION

BACKGROUND OF THE INVENTION

In the production of asphalt shingles and like products, unacceptable shingles produced during manufacture are currently sent to outdoor waste storage. Waste asphalt shingles have also been used as a source of energy with the subsequent re-use of the unburned solids in the manufacture of asphalt shingles. Such dumping and burning is uneconomical and destroys a valuable manufacturing product; i.e., asphalt. While asphalt-containing materials, such as short residue containing asphaltic and resinous materials have been treated to recover asphalt by solvent precipitation, e.g., propane deasphalting, there has been no attempts to treat waste asphalt shingles to recover the individual components thereof, let alone the asphalt base.

OBJECTS OF THE INVENTION

An object of the present invention is to provide a novel process for treating a multi-component waste material to recover the component parts thereof.

Another object of the present invention is to provide a novel process for treating waste asphalt shingles to recover the solid components thereof as well as asphalt.

A further object of the present invention is to provide an economic process for treating waste asphalt shingles to recover asphalt and solid components thereof.

Still another object of the present invention is to provide a novel solvent extraction process for treating waste asphalt shingles to form an asphalt-enriched miscella.

SUMMARY OF THE INVENTION

These and other objects of the present invention are obtained by the solvent extraction of particulated asphalt shingles in a plurality of contacts, preferably using a heptane fraction, to form an asphalt-enriched miscella which is separated from the solids material and which is subjected to evaporative techniques to separate asphalt from the solvent. The solid particles are passed to solids handling equipment for segregation into component parts, such as fiber, filler and granules.

BRIEF DESCRIPTION OF THE DRAWING

A better understanding of the present invention as well as additional objects and advantage thereof will become apparent upon consideration of the detailed disclosure thereof when taken with the accompanying drawing, wherein.

DETAILED DESCRIPTION OF THE INVENTION

It is to be understood that equipment, such as certain pumps, valves, indicators and the like have been omitted from the drawings to facilitate the description thereof and that the placing of such equipment at appropriate placing is deemed to be within the scope of those skilled in the art. To facilitate an understanding of the present invention, the process of the present invention will be described with reference to the treatment of defective asphalt shingles and roofing waste (hereinafter sometime referred to as "ASRW), it is being understood that other types of asphalt including materials may be similarly processed.

Figure 1A:
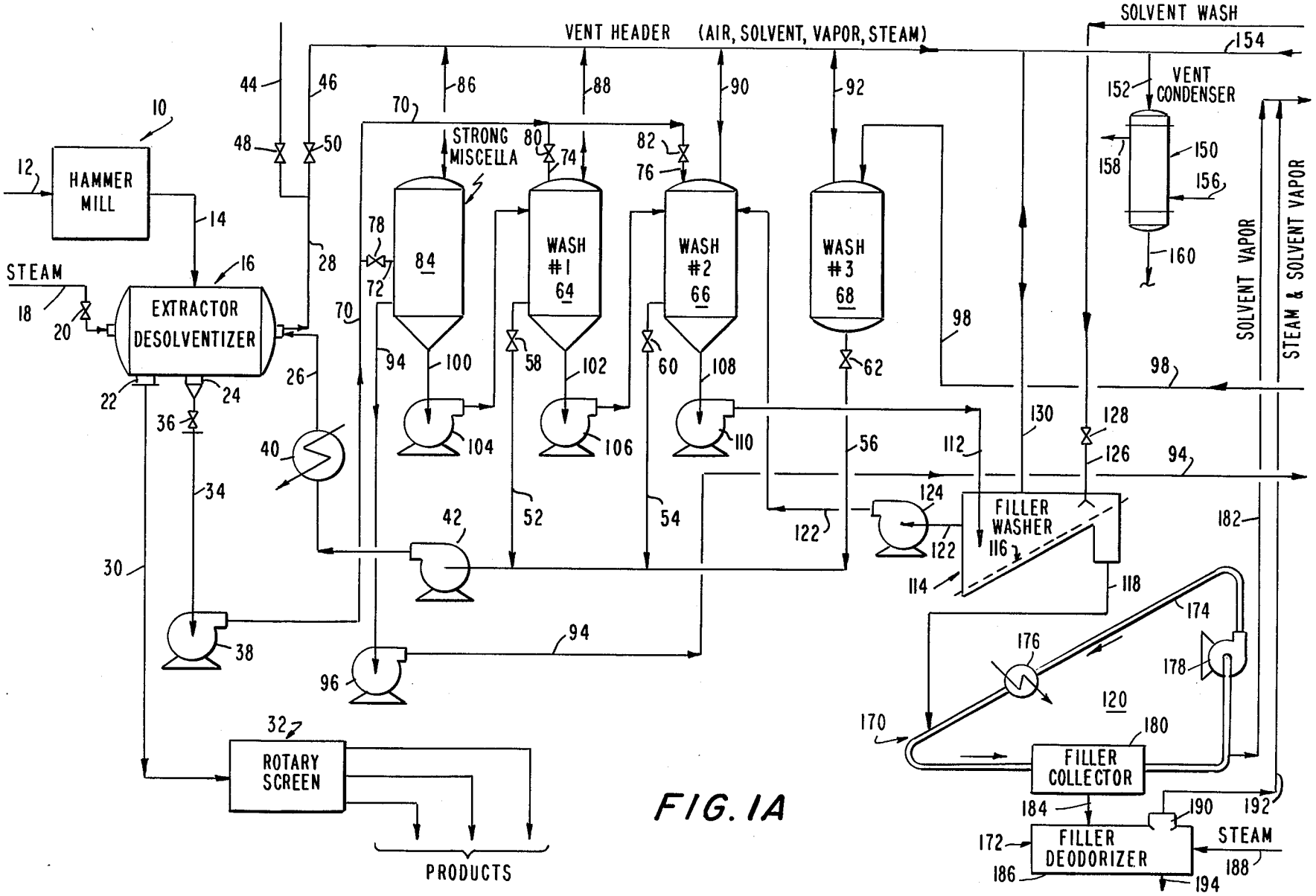
FIG. 1A is a schematic flow diagram of the solvent extraction and solids classification portion of the process of the present invention.

Referring to FIG. 1A, there is provided a hammer mill 10, such as a ring-type hammer mill known to those skilled in the arts. Asphalt shingle and roofing wastes (ASRW) in line 12 of a size suitable for shredding are introduced into the hammer mill 10 for shredding into pieces smaller than about 3"×3", a size suitable for subsequent solvent extraction. The shredded ASRW is withdrawn from hammer mill 10 and passed by line 14 to an extractor-desolventizer 16. The extractor-desolventizer 16 is a generally horizontally disposed drum journaled for rotation about a horizontal axis by a suitable drive assembly (not shown). The extractor-desolventizer 16 is provided with a steam inlet conduit 18 under the control of valve 20, a solids outlet 22, a liquid outlet 24, a liquid inlet conduit 26 and a vapor outlet conduit 28. The solids outlet conduit 22 is in solids communication by solids conveyor 30 with a rotary screen classifier, generally indicated as 32. The liquid outlet 24 of the extractor-desolventizer 16 is in fluid flow communication by line 34 under the control valve 36 with the suction side of a pump 38. The liquid inlet conduit 26 is in fluid flow communication via a heat exchanger 40 with the discharge side of a pump 42. The vapor outlet conduit 28 is in fluid flow communication with lines 44 and 46 under the control of valves 48 and 50, respectively, as more fully hereinafter discussed.

The extractor-desolventizer 16 of the present invention is a batch unit operated on a 3-cycle wash using solvent and miscellas of various concentration, as more fully hereinafter discussed. The suction side of pump 42 is in fluid flow communication by lines 52, 54 and 56 under the control of valves 58, 60 and 62 with tanks 64, 66 and 68, respectively. The discharge side of the pump 38 is in fluid flow communication via line 70 by lines 72, 74 and 76 under the control of valves 78, 80 and 82 with tanks 84, 64 and 66, respectively. The tanks 84, 64 and 68, are provided with vapor outlet conduits 86, 88, 90 and 92, respectively, in flow communication with line 46. The tank 84 is provided with a liquid outlet conduit 94 in fluid flow communication with the suction side of a pump 96. The tank 68 is provided with a recycle solvent conduit 98.

The tanks 84 and 64 are in fluid flow communication by lines 100 and 102 with tanks 64 and 66 via pump 104 and 106, respectively. The tank 66 is in fluid flow communication by line 108 with the suction side of a pump 110 with the outlet thereof being in fluid flow communication by line 112 with a filler-washer assembly, generally indicated as 114.

The filler-washer assembly 114 is provided with an inclined conveyer screw, generally indicated as 116, with solids being caused to be dragged from the liquid and over a vertical wall. The solids are withdrawn from the filler-washer assembly 114 by line 118 for passage to a desolventizer assembly, generally indicated as 120. The filler-washer assembly 114 is provided with a liquid conduit 122 in fluid flow communication with the tank 66 via a pump 124. The filler-washer assembly 114 is provided with a solvent conduit 126 under the control valve 128 and with a vapor conduit 130 in fluid flow communication with line 46.

The process of the present invention is provided with a vent condensor 150 having an inlet conduit 152 in fluid communication with conduit 46 and a conduit 154. The condensor 150 is of the shell and tube type exchanger having suitable inlet and outlet conduits 156 and 158, respectively, for the introduction and withdrawal of intermediate heat transfer media as is known to one skilled in the art. The vent condensor 150 is provided with a liquid outlet conduit 160.

The desolventizer assembly 120 includes a desolventizing portion and deodorizing portion, generally indicated as 170 and 172, such as described in U.S. Pat. No. 3,367,034, assigned to the same assignee as the present invention. The desolventizing section 170 is comprised of an elongated solid-gas contacting chamber 174 including a heat exchanger 176, a blower 178 and a solid collector 180. The solid-gas contacting chamber 174 is in communication with the filler-washer assembly 114 by line 118. The desolventizing section 170 is provided with a solvent vapor line 182 in fluid communication with the solid-gas contacting chamber 174. Solids withdrawn from the solid collector 180 by line 184 are passed to the deodorizing section 172 including a deodorizer vessel 186. The deodorizer vessel 186 is provided with a steam conduit 188, a vapor outlet 190 in fluid communication with line 192 and a solid outlet conduit 194.

Figure 1B:
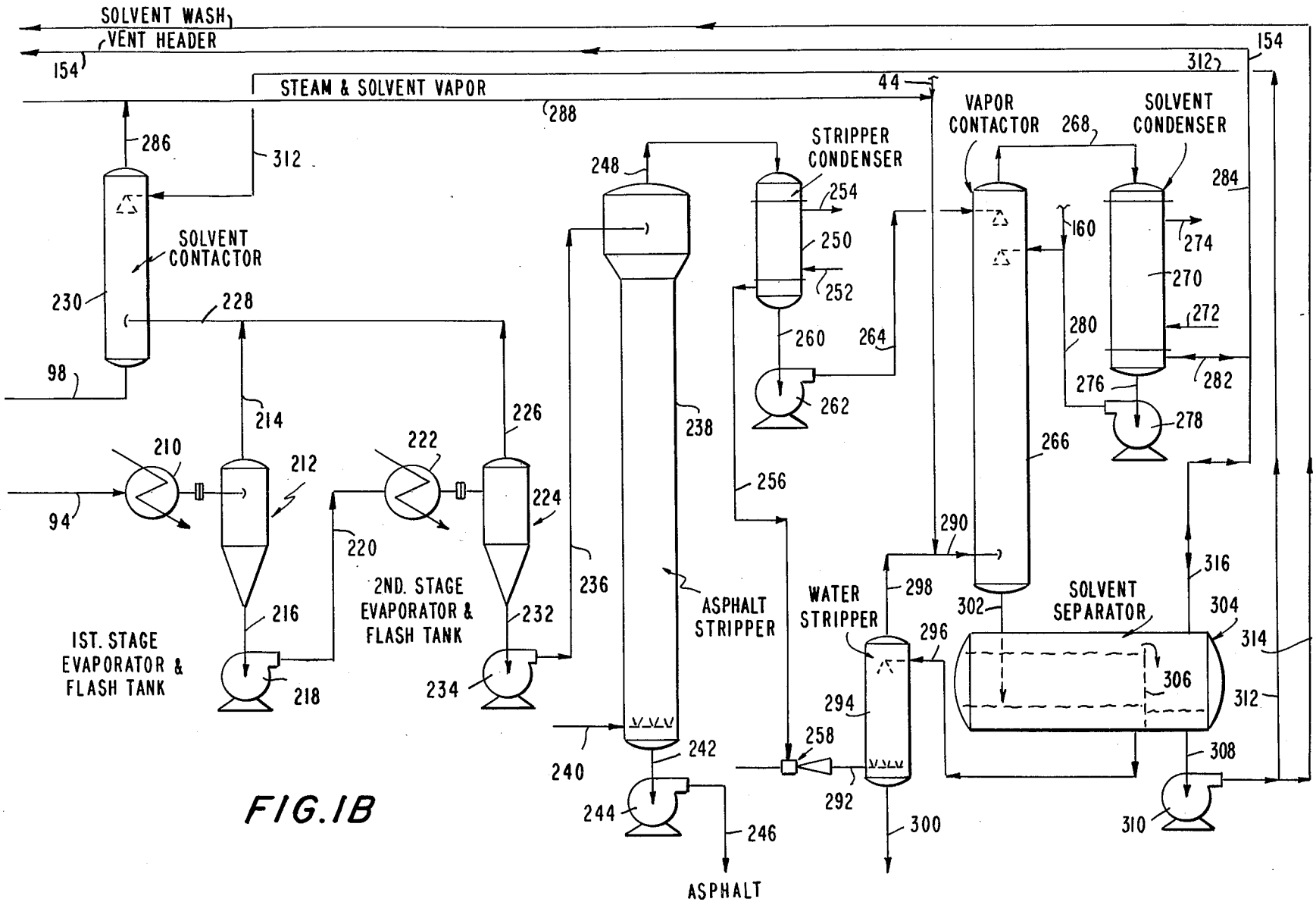
FIG. 1B is a schematic flow diagram of the remaining portion of the present invention relating to the separation of the asphalt enriched miscella into asphalt and solvent.

The asphalt-enriched miscella in line 94 is passed to the miscella treatment section of the present invention, referring now to FIG. 1B, through a heat exchanger 210 and introduced into a first stage evaporator and flash tank, generally indicated as 212. The first stage evaporator and flash tank 212 is provided with a vapor conduit 214, and a liquid conduit 216 in fluid flow communication with the suction side of a pump 218. The discharge side of the pump 218 is in fluid communication by line 220 via a heat exchanger 222 with a second stage evaporator and flash tank, generally indicated as 224. The second stage evaporator and flash tank 224 is provided with a vapor outlet conduit 226 in gaseous communication with line 214 by line 228 with a solvent contacting column 230. The second stage evaportor and flash tank 224 is provided with a liquid outlet conduit 232 in fluid communication with the suction side of a pump 234, with the outlet thereof being in fluid communication by line 236 with the upper portion of an asphalt stripping column 238.

The asphalt stripper 238 is provided with a steam inlet conduit 240 in the lower portion thereof for introducing steam into the asphalt stripping column 238, as more fully hereinafter described. The asphalt stripping column bottoms in line 242 is in fluid communication with the suction side of the pump 244 including a discharge outlet conduit 246. Overhead vapors in line 248 from the asphalt stripping column 238 are introduced into a condensor 250 of the shell and tube type heat exchanger provided with inlet and outlet conduits 252 and 254 for the introduction and withdrawal, respectively, of an intermediate heat transfer media. Vapors withdrawn from the condensor 250 by line 256 are introduced into a steam ejector assembly, generally indicated as 258. The liquid withdrawn in line 260 from condensor 250 is passed by a pump 262 by line 264 into the upper portion of a contacting column 266.

The contacting column 266 is provided with suitable contacting devices (not shown) wherein downwardly flowing liquid is passed in counter-current contacting relationship to upwardly flowing vapors. Vapor in line 268 is withdrawn from contacting column 266 and is passed to a solvent condensor 270 of the shell and tube type heat exchanger provided with inlet and outlet conduits 272 and 274 for the introduction and withdrawal, respectively, of an intermediate heat transfer media. A liquid refluxing stream in line 276 is withdrawn from condensor 270 by pump 278 and is introduced by line 280 into the contacting column 266 at a point below line 264. The condensor 270 is provided with a vapor conduit 282 in fluid communication by line 284 with line 154. Vapor in lines 182 and 192 together with an overhead vapor stream in line 286 from the solvent contacting column 230 are passed by line 288 to inlet conduit 290 of the contacting column 266 to provide a portion of the contacting vapors therefor.

The steam ejector 258 is in fluid communication by line 292 with a water stripping column 294 wherein vapor is contacted with a downwardly flowing liquid introduced into the stripper column 294 by line 296. An overhead vapor in line 298 from stripper column 294 is passed to line 290 and constitutes a portion of the vapors introduced into the contacting column 266. The stripper column 294 is provided with a waste liquid outlet 300.

A liquid bottoms in line 302 is withdrawn from the contacting column 266 and is introduced into a solvent separator tank, generally indicated as 304, for decantation of a water phase from a solvent phase. The separator tank 304 is provided with a weir 306 over which solvent, i.e., the upper layer of liquid, overflows into a portion of the separator tank 304 from which liquid solvent in line 308 is withdrawn by pump 310 and passed by lines 312 and 314 to the solvent contactor 230 and filler-washer tank 114, respectively. The separator tank 304 is provided with a vapor conduit 316 in fluid communication with the condensor 150 by lines 284 and 154. The water phase separated in separator 304 is withdrawn by line 296 and passed to the stripping column 294, as hereinabove discussed.

In general, the feed to the plant treating asphalt shingle and roofing waste (ASRW) would have the following composition:

| COMPONENT | % BY WEIGHT |
|---|---|
| Asphalt | 35–50 |
| Granules | 20–25 |
| Filler | 5–20 |
| Fiber | 20–25 |

The solvent is a commercial product of petroleum refining comprised primarily of the heptane fraction with a portion of the toluene fraction although it would be understood by one skilled in the art that other solvents may be used depending upon the feed composition and other processing requirements. The process of the present invention would be provided with a process program sequencer to control instruments, to start and stop motors, to open and close valves and to energize operator indicator devices to maintain necessary cycle times. It is obvious to one skilled in the art that the cycle times can be adjusted as dictated by the composition of the asphalt shingle and roofing waste (ASRW) as well as solvent composition.

Solvent extraction of the ASRW having the composition as hereinabove outlined is effected at temperatures of from 75° C. to 150° C., preferably of from 80° C. to 125° C. and at pressures of from 5 psig to 100 psig. The following discussion of an operational sequence relates to the contact of ASRW with three solvent streams of different concentrations generally for a time period of from about 15 minutes to about 25 minutes, although it will be understood by one skilled in the art that the number contacts, contact times, solvent, solvent concentrations and the like may be varied depending on material being treated, solvent, etc. with due consideration to economics of operation.

In operation, the ASRW, suitably shredded into smaller pieces, is introduced by line 12 into the hammer mill 10 for grinding into pieces smaller than about 3"×3". A solid feed inlet of the extractor-desolventizer 16 is open to permit the shredded and ground ASRW material to be introduced by line 14 into the extractor-desolventizer 16. After charging of the extractor-desolventizer 16, the solid feed inlet of the extractor-desolventizer 16 is closed and the extractor-desolventizer is caused to be rotated by a suitable drive and support mechanism (not shown) as known to one skilled in the art.

A preferred extraction sequence is to withdraw a miscella of intermediate strength from tank 64 through line 52 by pump 42 and to introduce such miscella by line 26 through heat exchanger 40 into the extractor-desolventizer 16 wherein the solids and liquid are contacted for a timer period sufficient to extract a portion of the asphalt from the crushed ASRW. After a preselected time period, the extractor-desolventizer 16 is caused to be stopped at a predetermined position to permit the outlet 24 to be connected to the conduit 34 for withdrawal by opening valve 36 of a miscella of higher asphalt concentration with such miscella being passed to tank 84 by lines 70 and 72. After a suitable drainage time period, the conduit 34 is closed by valve 36 and is disconnected from the outlet 24 with the outlet 24 being closed by an outlet closure (not shown) and the extractor-desolventizer drum 16 caused to again rotate about the support assembly (not shown).

A second contacting miscella of weaker strength is withdrawn from the tank 66 through line 54 by pump 42 and is caused to be introduced by line 26 via heat exchanger 40 into the extractor-desolventizer 16 for a second extraction cycle of the ASRW material. After a preselected time period, the extractor-desolventizer 16 is caused to be stopped at a predetermined position to permit the liquid outlet 24 to be connected to the conduit 34 for withdrawal by opening valve 36 of a miscella of increased asphalt concentration for passage by pump 38 via lines 70 and 74 to tank 64. After suitable drainage time period, the conduit 34 is closed by valve 36 and is disconnected from the outlet 24 with the outlet 24 being closed by outlet closure (not shown) with the extractor-desolventizer 16 being caused to again rotate about the support assembly (not shown).

A third contacting liquid, essentially pure solvent, is withdrawn from tank 68 through line 56 by pump 42 and passed through heat exchanger 40 by line 26 to the extractor-desolventizer 16 for a third contact sequence. After a preselected time period, the extractor-desolventizer 16 is again caused to be stopped at a predetermined position to permit the liquid outlet 24 to be connected to the conduit 34 for withdrawal by opening valve 36 of a weaker miscella by pump 38 and passage through lines 70 and 76 to tank 66.

After the third contact time period, the residual solid material is essentially asphalt-free. Prior to the removal of such solid material from the tank 16, the liquid outlet 24 is caused to be closed and steam introduced by line 18 into the extractor-desolventizer 16 to vaporize residual solvent in the solid material, i.e., extracted fiber, granules and filler. During such steaming step, the extractor-desolventizer 16 is preferably caused to be rotated to effect complete solvent vaporization. A rise in temperature of the vapor in line 28 leaving the extractor-desolventizer 16 signals a completion of solvent vaporization to the process program sequencer to stop the introduction of steam by line 18.

The extractor-desolventizer 16 is caused to be rotated for a predetermined time period after discontinuing the introduction of steam to promote vaporization prior to stopping of the rotation of the extraction-desolventizer 16 and opening of the solids outlet 22. During vaporization of the residual solvent from the solids, a steam-solvent stream is withdrawn by line 28 from the extractor-desolventizer 16 and passed by line 46 to the vent condenser 150. Upon completion of the vapor removal, rotation of the extractor-desolventizer 16 is stopped and the solid outlet cover (not shown) of the solids outlet 22 is removed. The vessel 16 is again caused to be rotated to permit the discharge of the solids therefrom which are passed by conveyor 30 to the rotary screen classifier 32. In practice, the conveyor 30 returns the solid material to the rotary screen 32 located in the asphalt shingle production area and having a storage capacity necessary to synchronize the normal through-put rate of the rotary screen.

The rotary screen classifier 32 is provided with two cylindrically-shaped screens of different size concentrically mounted within an inclined drum suitably positioned on bearing members for rotation by a drive assembly (not shown), such as known to one skilled in the art. The rotating action of the drum causes the solid material to be lifted and showered through the screens with the inner screen retaining fibers and the outer screen retaining granules with the filler passing through the screens. An air stream is passed through the drum to remove filler dust which is pneumatically conveyed to a suitable bag collector.

The liquid streams withdrawn from the extractor-desolventizer 16 passed to the various tanks during operation of the extraction cycle will contain filler. The tanks 84, 64 and 66 are formed with conically-shaped bottoms to facilitate collection of such filler as the filler settles between extraction cycles. The program process sequencer actuate the pumps 104, 106 and 110 to transfer miscella in the tanks 84, 64 and 66, respectively, to tanks 64 and 66 and the filler-washer assembly 114, i.e. a flow counter to that of the wash liquid. In this regard, each transfer volume is small compared with the volume of wash liquid thereby not significantly disturbing the concentration gradient between washes in the respective tanks. The settlings; i.e., filler containing weak miscella is passed to the filler-washer 114. The inclined conveyor 116 positioned within the filler-washer 114 drags the settlings out of the liquid with subsequent washes with fresh solvent in line 126. The conveyor 116 continues to move the settlings or filler further up the inclined wall of the filler-washer assembly 114 while allowing for drainage of the solvent. The solid filler is caused to discharge over a vertical wall portion of the filler-washer tank 114 from which a washed and drained filler including residual solvent is withdrawn by line 18 and passed to the desolventizer and deodorizer system 120. A weak miscella is withdrawn from the filler-washer tank 114 by line 122 and is passed by pump 124 to tank 66 via line 122.

The solvent-wet filler in line 118 is desolventized in the elongated conduit 174 wherein superheated solvent vapor is caused to pneumatically convey the filler while simultaneously vaporizing solvent by desuperheating the conveying solvent gas. The solvent gas in the conduit 174 is reheated in the exchanger 176 to convey more filler and vaporize more solvent with net vaporized solvent being withdrawn by line 182 for subsequent recovery in contacting column 266. Filler withdrawn by line 184 from the filler collector 180 still contains a small fraction of solvent and is introduced into deodorizer vessel 172 and contacted with steam introduced by line 188 to produce an odor-free product in line 194.

Concentrated miscella in tank 84, from which filler has settled is continuously passed through line 94 by pump 96 and is introduced by line 94 through heat exchanger 210 into the first stage evaporator and flash tank 212. The rate of withdrawal of the strong or concentrated miscella from the tank 84 is controlled to balance the miscella treating portion of the plant with the batch extraction cycle. During passage of the strong miscella through the heat exchanger 210, the miscella is raised to its boiling point prior to introduction in the first stage recirculating-type evaporator 212. In the first stage evaporator 212, the miscella is concentrated under pressure to a viscosity to facilitate pumping of the bottoms in line 216 by pump 218 to the second stage recirculating-type evaporator 224 via heat exchanger 222.

The liquid stream in line 220 is further concentrated in the second stage evaporator 224 to vaporize solvent therefrom at a higher temperature and operating under a pressure to obtain an asphalt fraction containing of from 90 to 95% asphalt. A concentrated asphalt bottoms from the second stage evaporator 224 in lines 232 is passed by pump 234 through line 236 to the upper portion of the asphalt stripping column 238 wherein the concentrated asphalt is contacted in counter-current direct contact with steam under vacuum to remove residual solvent which is withdrawn by line 248. A commercially grade substantially solvent-free asphalt is withdrawn from the asphalt stripping column 238 as bottoms in line 242 and is passed by pump 244 through line 246 to storage (not shown).

Solvent vapors in line 214 and 226 withdrawn from first and second stage evaporators 212 and 224, respectively, are combined and passed by line 228 to the solvent contacting column 230 wherein such combined vapor is passed in counter-current contact with liquid solvent in line 312 to condense a major portion of the solvent which is withdrawn from the solvent contacting column 230 by line 98 for passage to tank 68.

Vent gases from the various processing units are gathered in conduits 46 and 154 to be combined in line 152 for introduction into the vent condensor 150 to recover residual quantities of solvent contained therein.

In contacting column 266, the vapor stream in line 290 is passed in counter-current contacting relationship to a liquid formed by combining the liquids in lines 264 and 280 simultaneously providing for the desuperheating of the vapor stream while reheating subcooled condensate from the condensors 250 and 270. Thus in contacting column 266, the liquid is sprayed and/or splashed downwardly through ascending hot vapor to provide for the intimate contact therebetween. Heat recovered in the solvent liquid phase in line 302 facilitates water-solvent separation in separator tank 304.

In the solvent separator tank 304, water which is heavier than the extraction solvent is separated by decantation with a solvent steam overflowing the weir 306 into a separation compartment of the separator tank 304. The solvent separator tank 304 acts as a surge tank for the process of the present invention. Waste water is eventually withdrawn from the process of the present invention by line 300 from stripper column 294.

Numerous modifications and variations of the present invention are possible in light of the above teachings and therefor the invention may be practiced otherwise and as particularly described.

What is claimed:

1. A process for treating a solid waste material obtained in a process for manufacturing asphalt shingles and comprised of asphalt and solid components including filler and granules to recover asphalt and said components which comprise:

(a) shredding said solid waste material
(b) introducing said solid waste material into a contact zone;
(c) introducing extraction solvent streams of successively increasing solvent concentrations into said contact zone;
(d) intimately contacting said solid waste material with said extraction solvent for a time sufficient to dissolve said asphalt and form an asphalt-enriched miscella;
(e) separating said asphalt-enriched miscella from solid components; and
(f) separating and recovering by evaporation techniques asphalt and extraction solvent from said asphalt-enriched miscella.

2. The process as defined in claim 1, wherein said residual solid components are separated into filler and granules.

3. The process as defined in claim 1 wherein said extraction solvent is a fraction obtained in refining of petroleum.

4. The process as defined in claim 1 step (b), wherein each contact is effected for a time of from about 15 to 25 minutes.

5. The process as defined in claim 1 step (b), wherein said residual solid material is steamed prior to removal from said contact zone.

6. The process as defined in claim 1, wherein said extraction-solvent is returned to said contact zone.

7. The process as defined in claim 1 step (b), wherein asphalt-enriched miscella resulting from each contact step is passed to three successive storage zones.

8. The process as defined in claim 7, wherein the asphalt-enriched miscella from the first of said successive storage zones is continuously passed to said separation and recovery step of step (e).

9. The process as defined in claim 8 wherein a liquid bottoms including solid filler are withdrawn from each successive storage zone and wherein said liquid bottoms from the first and second storage zones are passed to said second and third storage zones, respectively, and wherein said liquid bottoms from said third storage zone is treated to recovery filler therefrom.

10. The process as defined in claim 9, wherein said filler is contacted with solvent vapors to remove adsorbed solvent prior to filler recovery.

11. The process as defined in claim 10, wherein filler separated from miscella is contacted with fresh extraction solvent.

12. The process as defined in claim 1, wherein said asphalt-enriched miscella is treated in a plurality of multiple evaporation steps to form an asphalt-enriched stream which is stripped to remove residual solvent prior to asphalt recovery.

13. The process as defined in claim 12, wherein the vapors from said multiple evaporation steps is contacted in a rectifying zone with extraction solvent to form a solvent stream which is returned to step (b).

14. The process as defined in claim 13, wherein a vapor stream withdrawn from said rectifying zone is contacted with subcooled condensate to reheat said subcooled condensate and desuperheat said vapor stream thereby to facilitate solvent water separation.

* * * * *